United States Patent [19]

Selak

[11] Patent Number: 4,714,242

[45] Date of Patent: Dec. 22, 1987

[54] SHEET FEEDING APPARATUS

[76] Inventor: Martin Selak, 578 S. Warrington Rd., Des Plaines, Ill. 60016

[21] Appl. No.: 842,622

[22] Filed: Mar. 21, 1986

[51] Int. Cl.[4] ..... B65H 3/08

[52] U.S. Cl. ..... 271/100; 271/106; 271/107

[58] Field of Search ..... 271/100, 101, 99, 102, 271/104, 106, 107, 108, 20; 221/211; 414/128

[56] References Cited

U.S. PATENT DOCUMENTS

| | | | |
|---|---|---|---|
| 3,893,664 | 7/1975 | Thomsen | 271/100 |
| 4,437,657 | 3/1984 | Selak | 271/100 |
| 4,505,470 | 3/1985 | Reinert | 271/100 |

*Primary Examiner*—Richard A. Schacher
*Attorney, Agent, or Firm*—Russell E. Hattis

[57] ABSTRACT

Sheet feeding apparatus comprises suction cups which initially engages the bottom surface of a bottommost sheet in a stack of sheets, with the suction plane thereof parallel to the sheet. The suction cups are then raised a small distance where the cups are tilted in a direction away from a support ledge without any substantial horizontal movement thereof, and following which the suction cups are lowered to pull the front end of the bottommost sheet past the support ledge with a wiping contact and down upon the top and front portions of a drive roller. Adjustable suction cup position control apparatus is provided including a manually progressively adjustable member for varying the peak elevation reached by the suction cups. A stationary cam is provided against which a pivotable follower portion of a suction cup mounting member rides, to vary the inclination of the mounting member and the suctoin cups carried thereby as the elevation of the suction cups is varied. The common gripping plane of the suction cups are maintained at an angle corresponding to the varying tangent lines extending from the varying points of contact of the sheet as it is pulled down upon the drive roller. Suction to the cups is shut-off when pressure rollers are raised to catch a rigid sheet as it springs upward upon release of suction to the suction cups.

6 Claims, 16 Drawing Figures

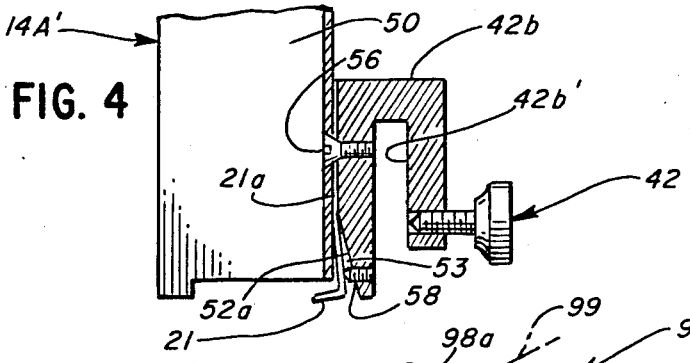
FIG. 4
FIG. 3
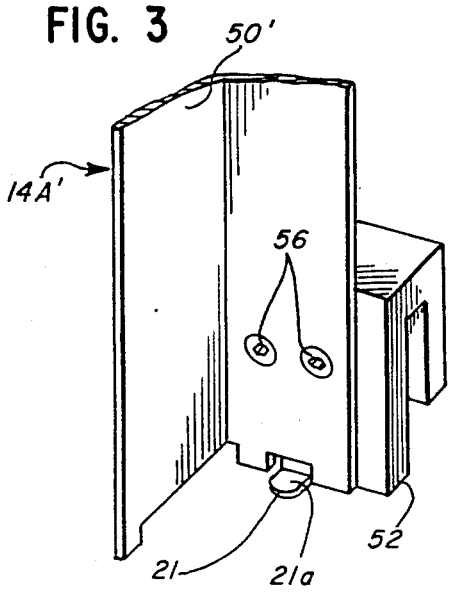
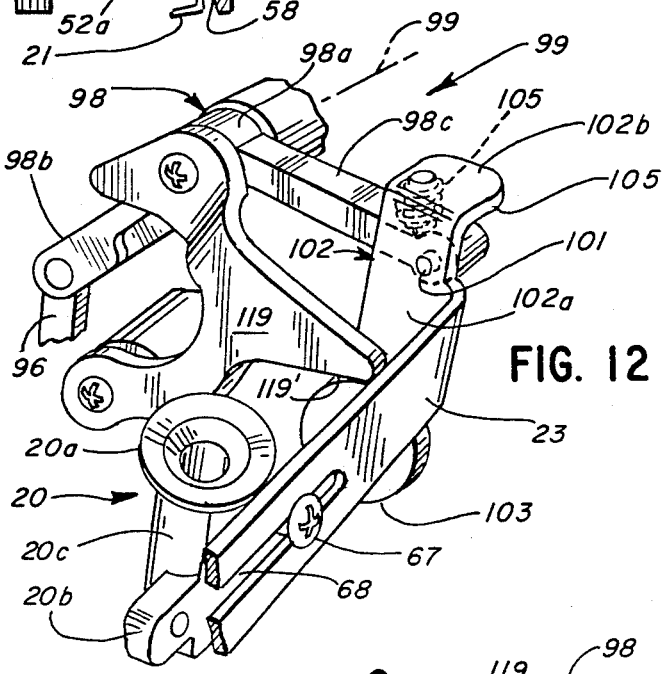
FIG. 12
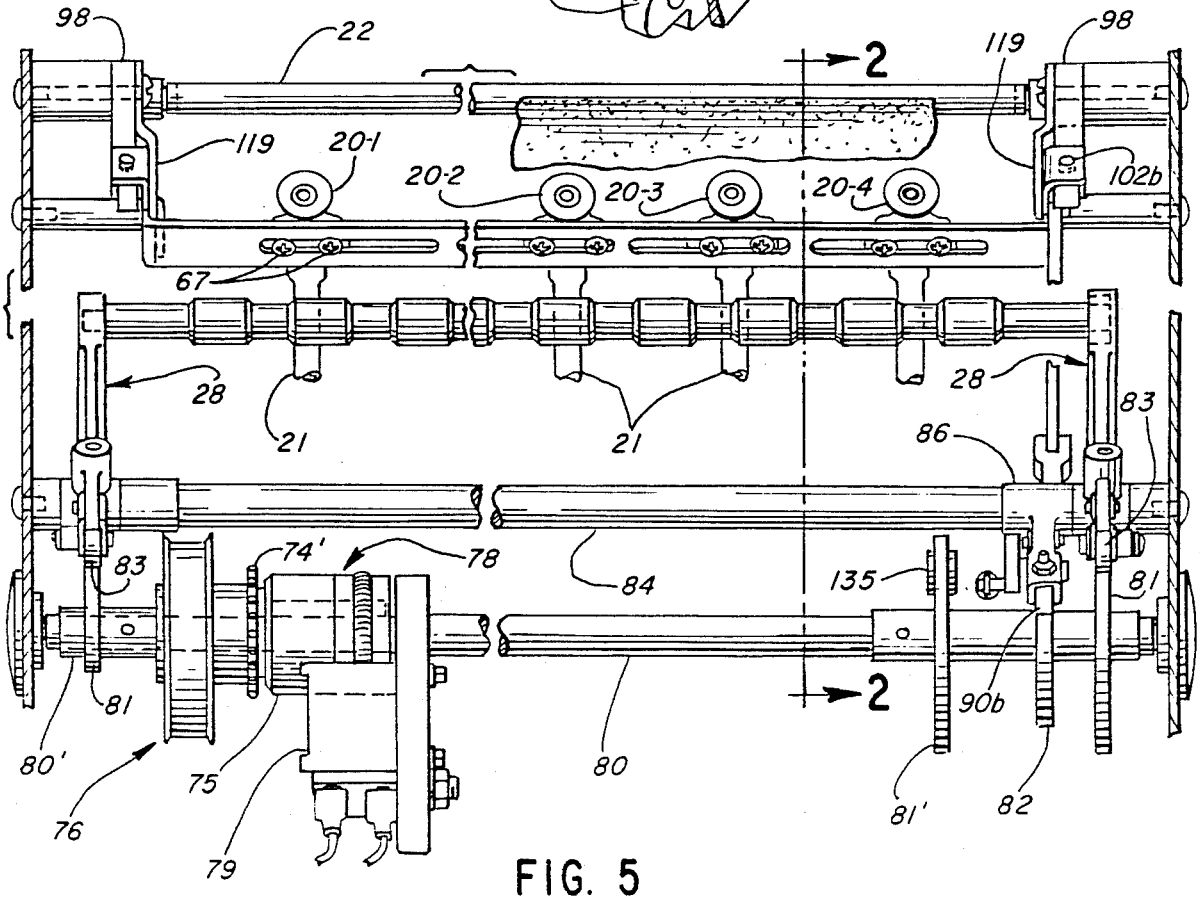
FIG. 5

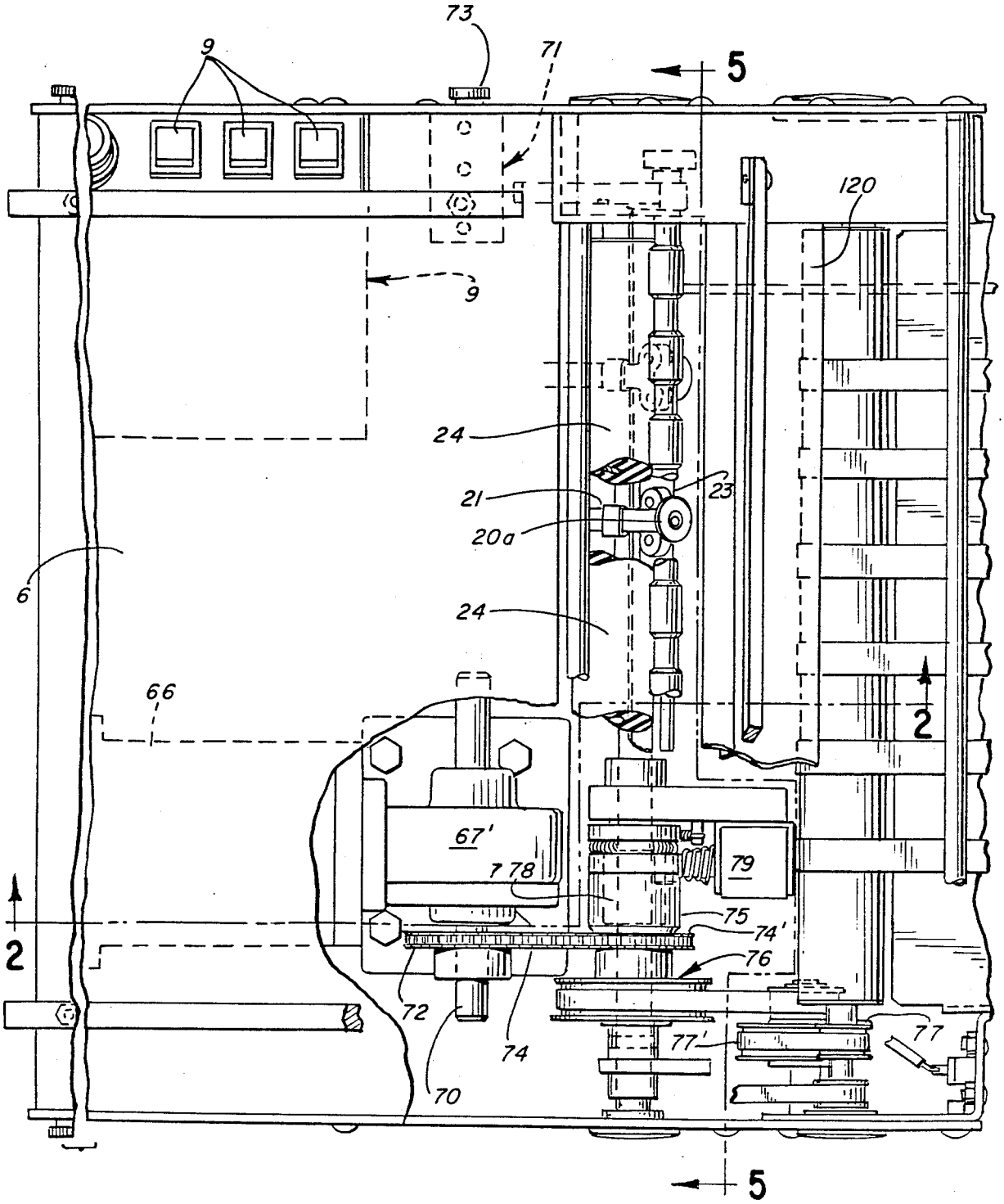
73
9
71
5
120
9
24
21
23
20a
6
24
66
2
67'
78
79
75
74'
76
2
72
74
77'
77
70
5

FIG. 7A
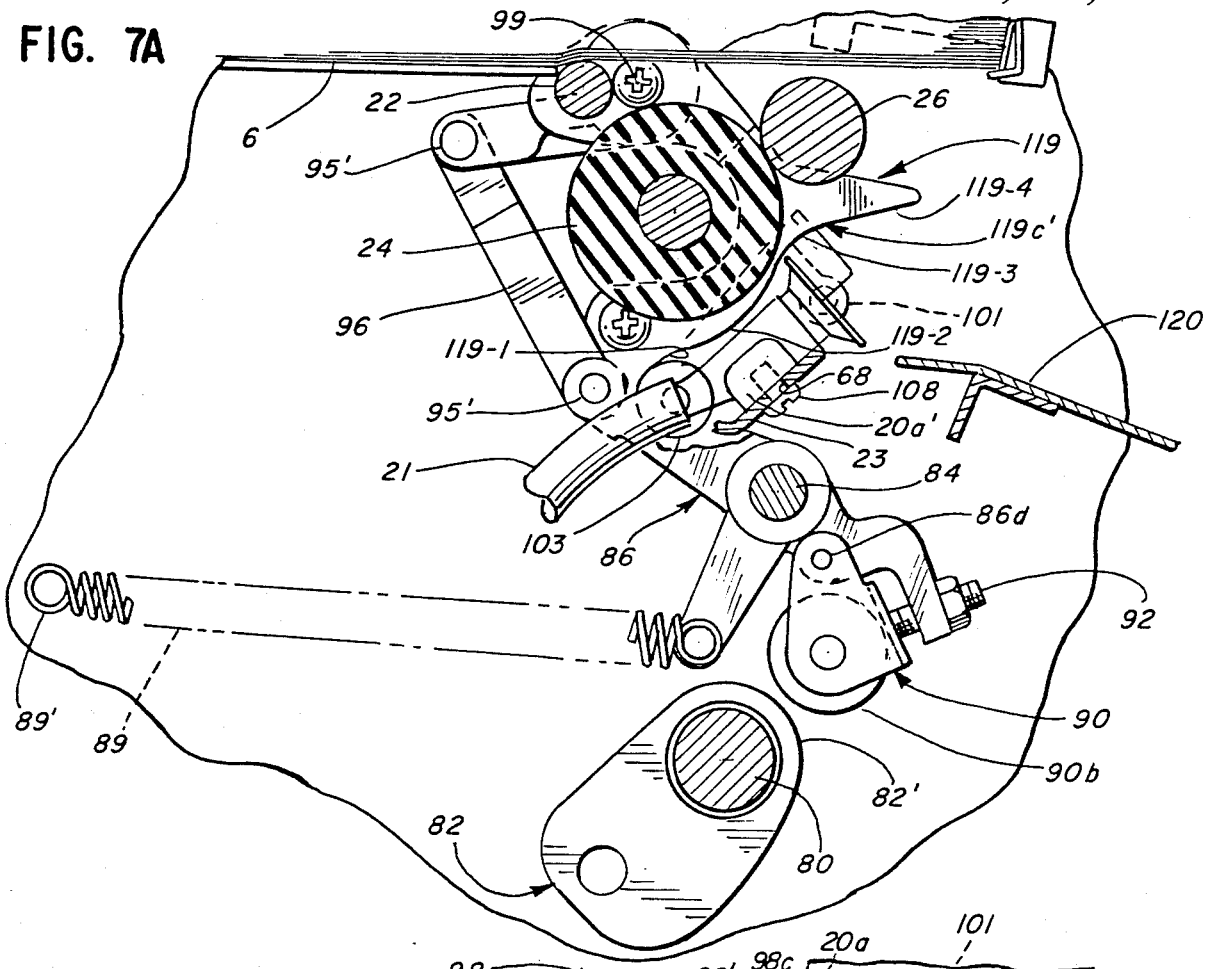
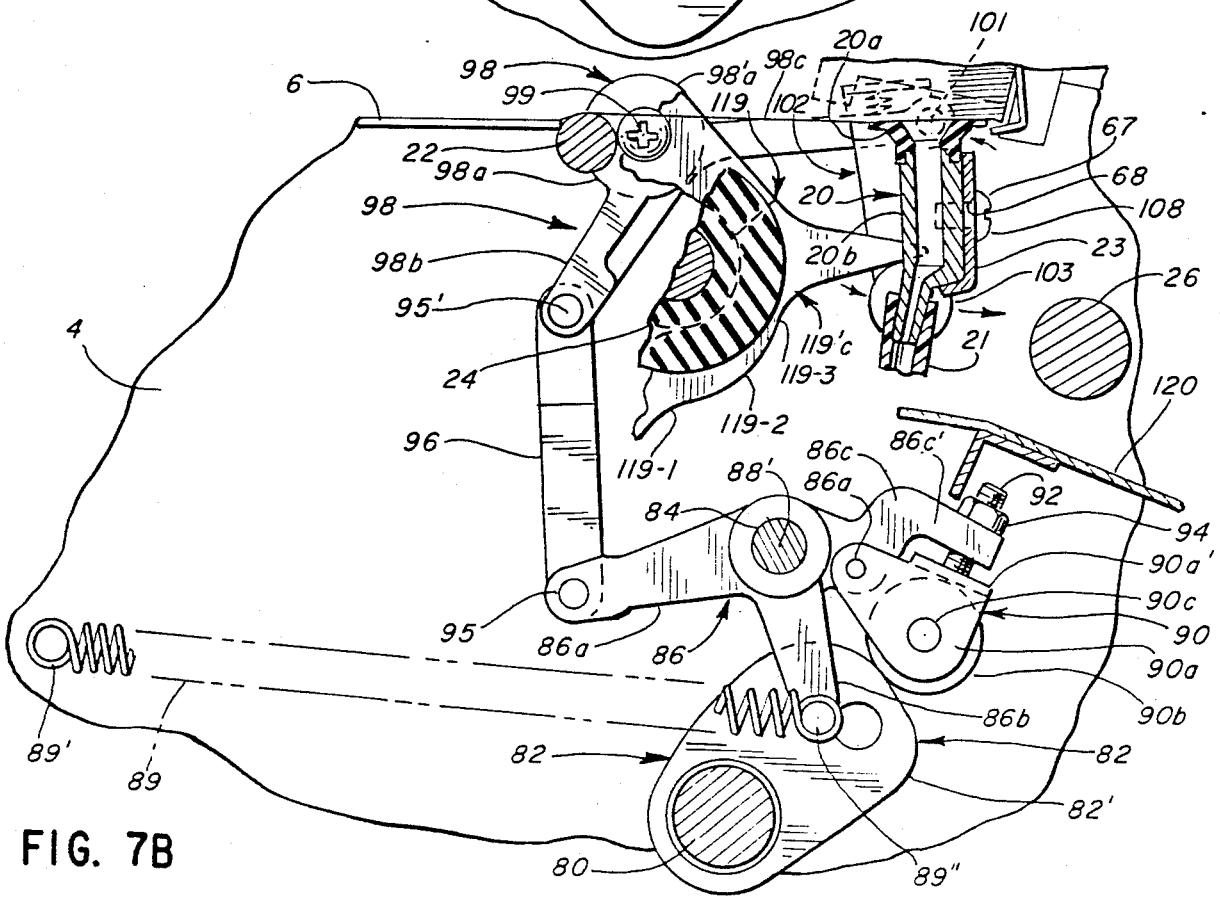
FIG. 7B

FIG. 8A
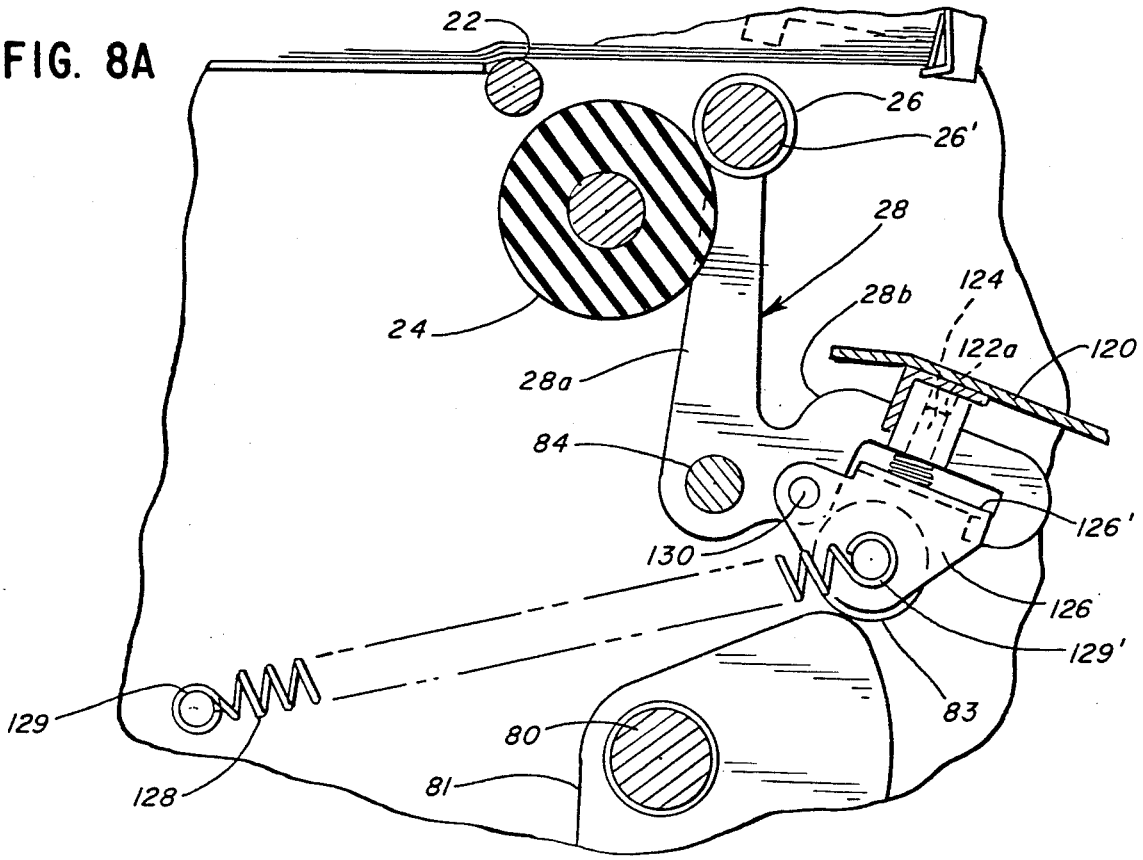
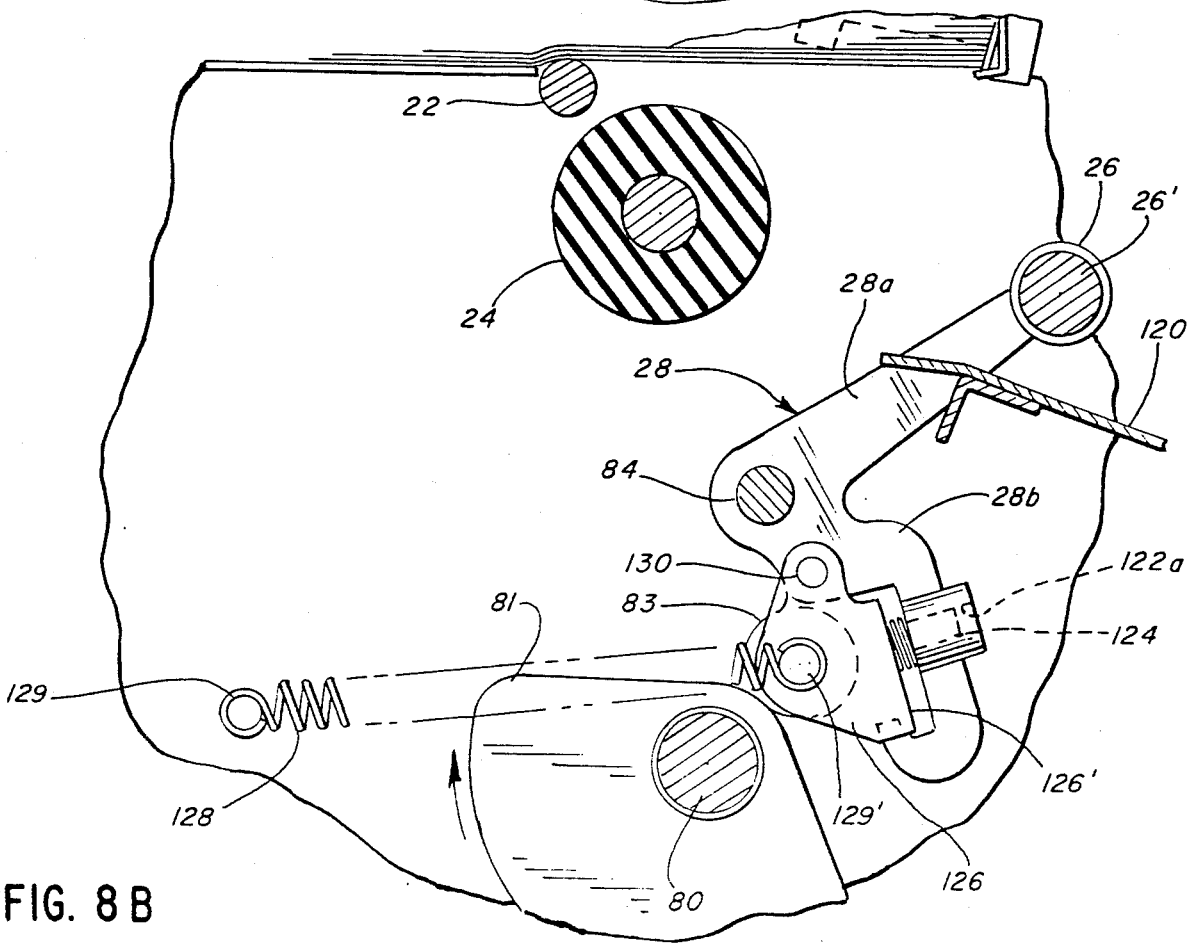
FIG. 8B

FIG. 13
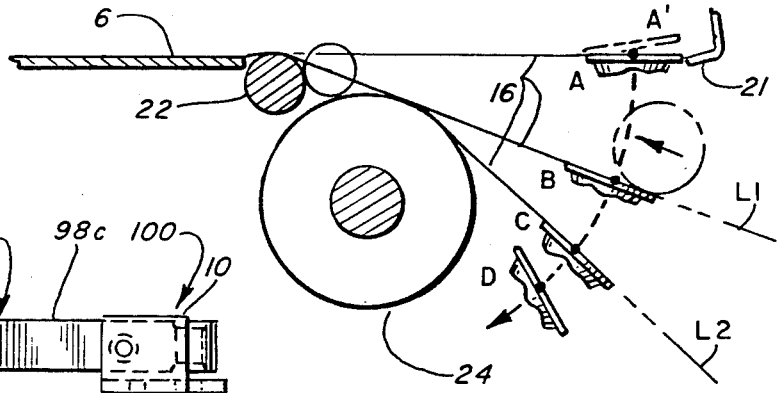
FIG. 9
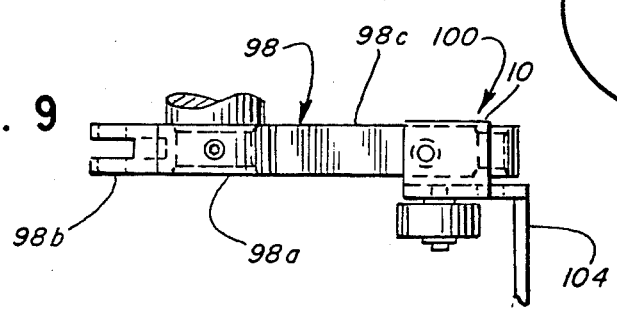
FIG. 10
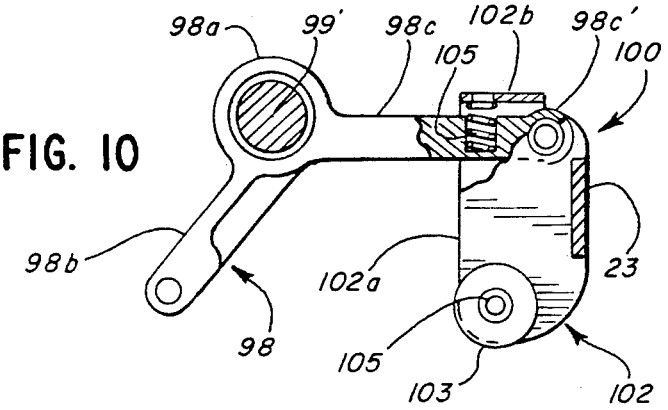
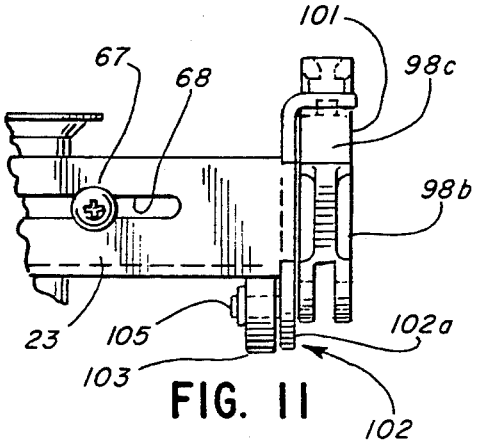
FIG. 11
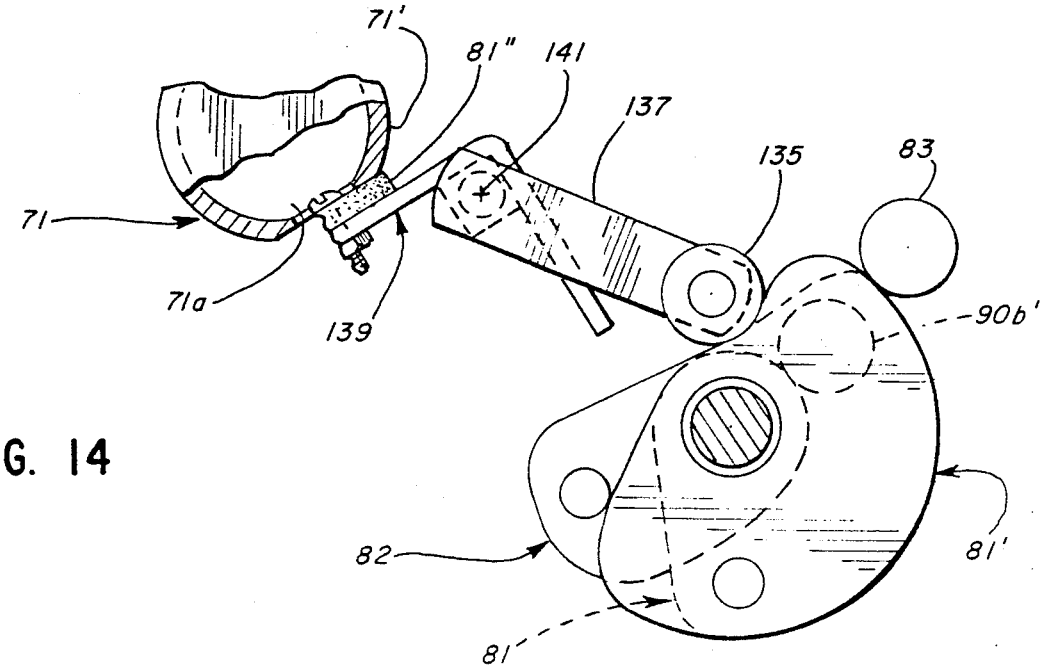
FIG. 14

SHEET FEEDING APPARATUS

BACKGROUND OF THE INVENTION

The present invention is an improvement over the sheet feeding apparatus disclosed in U.S. Pat. No. 4,437,657, granted Mar. 20, 1984. As disclosed therein, the feeding apparatus includes a fairly large number (e.g. 10) of fixed-in-position spaced suction cups supported on a common support or mounting member which may be a rigid pneumatic feed tube. The suction cup support member is movable between an initially lowered position and a raised position where the suction planes of the suction cups are parallel to and engage the bottom exposed surface of the bottommost sheet in a stack of the same held in a top loadable stacking frame, so that the operation of the apparatus does not have to be interrupted when the supply of sheets is to be replenished. The stack of sheets preferably rests on a slightly forwardly inclined support tray which terminates short of the lower front end of the stack to leave an opening running the entire width of the stack to expose thereat the bottom sheet in the stack for engagement by one or more of the suction cups. The front end of the stack rests on longitudinally adjustable flexible support lips so that when the bottommost sheet is pulled from the stack by the lowering of the suction cups, the sheet deflects and wipes by the deflected lips, which spring back to retain the next sheet within the stacking frame.

As disclosed in this patent, the suction cups described are pivotally supported with respect to the means which raises and lowers them so that the suction cups have uniquely tilted positions with respect to the bottommost sheet in the stack of sheets involved, which ensures that only the bottommost sheet is withdrawn from the stack for sheets of widely varying flexibility. To avoid the necessity of moving the suction cups bodily horizontally away from the rigid support ledge previously needed to clear the same, which sometimes had caused slippage and premature release of the suction cups from rigid sheet materials, the suction cups are moved only relatively slightly, if at all, in a horizontal direction away from the flexible lip support ledges described. This permits the removal of the bottommost sheet by a primarily downward movement thereof, where the front end of even a relatively rigid sheet of material can be pulled easily by the flexible support ledge-forming lips by a wiping, lip-flexing action, as previously described.

Flanged brackets rigidly extend from the ends of the suction cup support member, the brackets having vertical portions pivotally supported and carried upon the ends of a pair of remotely pivoted crank arms which are raised and lowered to move the suction cups carried by the support member between the lowered and raised positions described. Spring means extend between the crank arms and horizontal flanges on the brackets at the ends of the suction cup support member to urge the latter into a stable position, where the suction planes of the suction cups are parallel to each other.

When the suction cups are raised to an elevation slightly below a point where they contact the bottommost sheet in the stack, the bracket flanges initially engage one or more vertically adjustable abutment shoulders at a point spaced from the pivot axis, so that a small additional upward movement of the suction cup support member results in pivoting of the member on the link arms. In this position of the suction cup support member, the suction planes of the suction cups are almost parallel to this sheet, so that when the support member is raised further to effect this contact, the suction planes are substantially parallel thereto. The support member is raised slightly above this position of initial suction cup contact where it and the suction cups carried thereon are pivoted substantially rapidly in a direction to tilt the suction cup planes away from the flexible support ledge, without significantly shifting the horizontal position of the suction cups along the sheet. The latter pivoting action separates the bottommost sheet from the other sheets in the stack without causing separation of the suction cups from the bottommost sheet.

The crank arms and suction cup support member are then lowered to bring the front end of the sheet partially pulled from the stack thereof against the top and front portion of a drive roller. As the suction cups are thus lowered, idler pressure rollers carried on the ends of link arms are raised into position over and toward the drive roller where the pressure rollers press the sheet against the drive roller. The suction cups separate from the sheet before the pressure rollers press the sheet against the drive roller. This may be accomplished by terminating suction applied to the suction cups.

It was discovered that the just described method of controlling the pivoting of the pivotably mounted suction cup support member, while satisfactory for most purposes, does not provide the most ideal adjustable control of the suction cup positions to ensure the most reliable removal of the bottommost sheet in a stack of sheets having all ranges of flexibility. For example, while the elevation of the abutment shoulders controlling the pivotal movement of the suction cup support member are adjustable as described, this adjustment only affects the degree of suction cup pivot action. There was no convenient progressive manual adjustment or control over the peak elevation of the link arms and the suction cups pivotally carried thereon. Such control was found to be useful in assuring separation of the bottommost sheet for a greater range of sheet flexibilities.

There was also no control over the angle of the suction cups when they were lowered from their peak positions to bring the front end of the sheet against the drive roller as described. When the sheet material is a fairly rigid material, as the sheet contacts the top surface of the drive roller it was found that the forces reacting on the sheet as it was pulled down upon the drive roller sometimes caused a premature separation of the suction cups from the rigid sheet before suction thereto was terminated and before the sheet could be contacted by the pressure rollers. The result was that the rigid sheet could spring upward out of the path of movement of the pressure roller where it would not be feedable by the drive roller and thus cause jamming of the machine.

SUMMARY OF THE INVENTION

One of the features of the present invention is to provide a readily progressively adjustable means for adjusting the peak elevation of the crank arms carrying the suction cup support member so as easily adjust the maximum elevation of the suction cups. This is most advantageously achieved by a screw adjustment associated with a crank member and cam follower which controls the elevation of a link attached to the crank member which carries an end of the suction cup support member.

Another feature of the invention, preferably but not necessarily combined with this peak elevation control means, is to provide cams or other suitable means which precisely control and vary the angular position of the suction cups relative to the carrier thereof (e.g. the crank arms referred to) as it traverses all of its different positions, so that the gripping planes of the suction cups will have their most ideal positions for the most reliable removal of sheets of all degrees of flexibility. Also it was found that the undesired premature release of the suction cups from a rigid sheet as described is avoided by keeping the suction cup planes parallel to the tangent lines of varying points on the drive roller progressively engaged by the sheet as it is pulled down upon the top and front of the feed roller.

The above and other advantages and features of the invention will become apparent upon making reference to the specification and claims to follow and the drawings.

DESCRIPTION OF DRAWINGS

FIG. 3 is a fragmentary perspective view of one of the front support ledge-carrying upstanding guide members at the loading section of the sheet feeding apparatus;

FIG. 4 is a fragmentary vertical sectional view through the upstanding guide member of FIG. 3;

FIG. 5 is a broken away vertical transverse sectional view through the sheet feeding apparatus, taken along section line 5—5 in FIG. 6;

FIG. 6 is a plan view, partly broken away view of the sheet feeging portion of the apparatus of FIGS. 1-5;

FIGS. 7A and 7B respectively show the position of the crank member linkages and cam controlling the movement and angularity of the suction cup support member for the lowest and the highest positions of the support member for a given peak elevation adjustment of the apparatus there shown;

FIGS. 8A and 8B show the corresponding extreme positions of the crank members and cams controlling the movement of the pressure rollers when the pressure rollers are respectively in their highest positions where they can press a partially removed sheet (not shown) against the drive roller and in their lowest positions;

FIG. 9 is a fragmentary top plan view at one end of the suction cup support member and shows the crank member and suction cup support member bracket carried thereby;

FIG. 10 is a side elevational view of the structure shown in FIG. 7, with part of the crank member broken away;

FIG. 11 is a broken away front elevational view of the structure shown in FIG. 7;

FIG. 12 (shown next to FIGS. 3 and 4) is a perspective view of the structure shown in FIGS. 7 through 9 with a stationary cam added thereto;

FIG. 13 shows the various positions of the planes of the suction cups and the sheet gripped thereby as the suction cups are lowered from their peak positions to bring the sheet against the drive roller; and FIG. 14 is a fragmentary vertical sectional view of the sheet feeding apparatus, as seen along section lines 14—14 in FIG. 5 and shows the suction control cam and movable element controlled thereby, as well as the other cams.

GENERAL DESCRIPTION OF EXEMPLARY FORM OF THE INVENTION

Figures 1, 2:
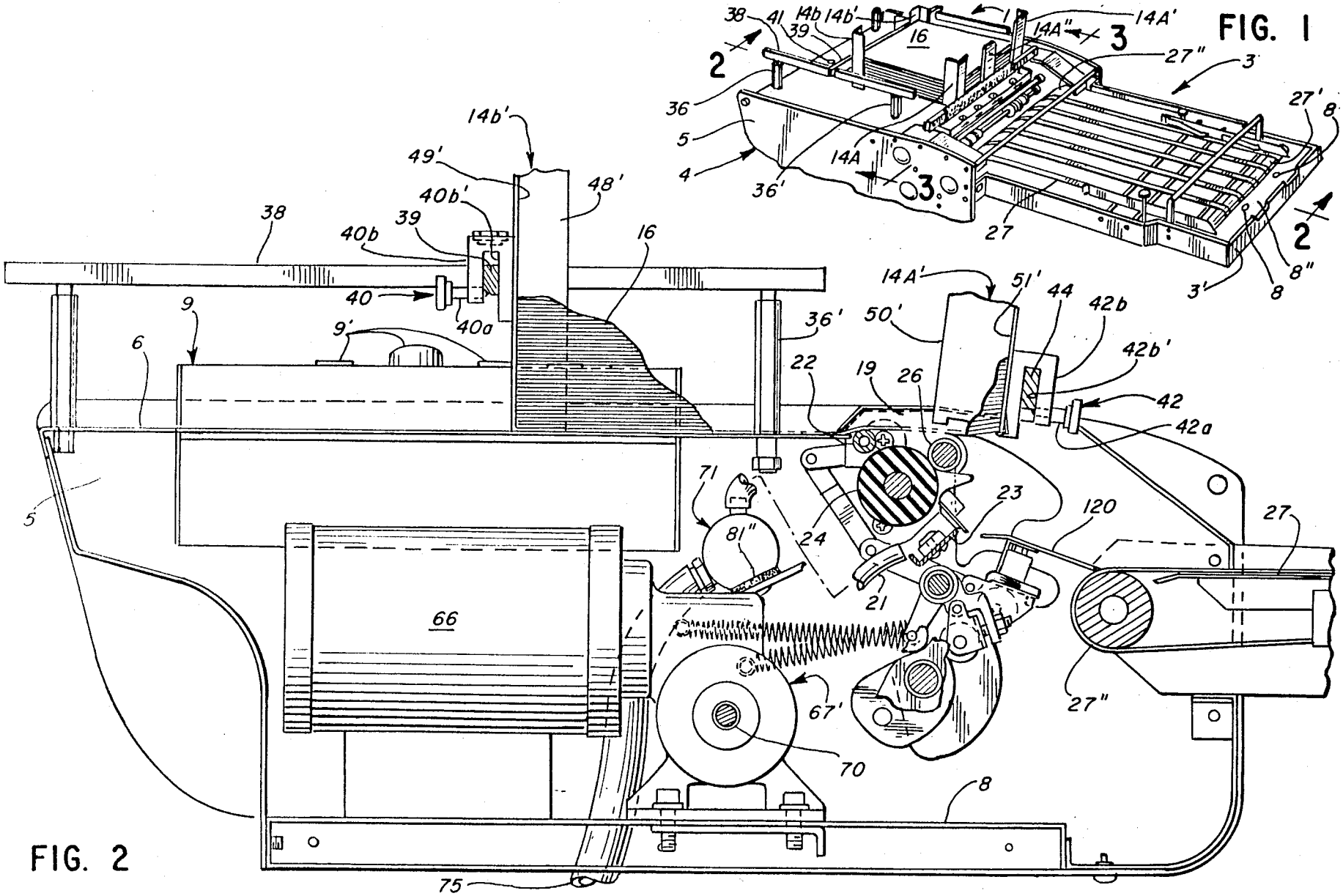
FIG. 1 is a perspective view of the sheet feeding apparatus of the invention.
FIG. 2 is a greatly enlarged fragmentary longitudinal sectional view through the sheet feeding apparatus of FIG. 1, taken along section line 2—2 shown in FIGS. 1 and 6.

Referring now more particularly to FIGS. 1 and 2, the sheet feeding apparatus of the invention illustrated therein comprise a loading section 1, a sheet feeding section 2 and a conveyor section 3 contained within a housing 4.

The housing 4 includes longitudinal side walls 5—5, a bottom wall 8 and a slightly forwardly and downwardly inclining top wall 6 which forms a support tray for one or more stacks of sheet material to be fed one at a time from the bottom of each stack. (Reference to sheets or sheet material is intended to encompass envelopes, as well as individual single thickness sheets of material, having widely varying degrees of thickness and flexibility.) The housing 4 encloses a compartment 7 (FIG. 2) which contains the mechanical and electrical devices for operating the various parts of the apparatus to be described, a control box 9 (FIG. 6) having, in addition to electric control circuitry (not shown), various control pushbutton and knobs 9' for separately turning on and off an electric motor 11 and a pump (not shown).

The loading section 1 is adapted to support, for both lateral and longitudinal adjustment, upstanding forward guide members 14A, 14A' and 14A" and upstanding rear guide members 14B-14B' which confine a stack of sheets 16 of widely varying dimensions. The support tray 6 on the bottom of the loading station 1 terminates short of an adjustable support ledge formed by spring fingers 21 (FIGS. 2-4) confronting a feed opening 19 and carried by the front upstanding guide members. The widths of the ledge formed by the spring fingers 21 is variable.

The bottommost sheet of each stack of sheets or envelopes involved is withdrawn downwardly from the stack by four suction cup units 20 (identified sometimes separately as 20-1, 20-2, 20-3 and 20-4 in FIG. 5, adjustably horizontally mounted on a support bar 23, in turn, secured to carrier means including various rockable links and crank arms to be described. The carrier means effect the raising of the suction cup units 20 from a lowered position to a raised position below a feed opening 19. Suction is applied to selected suction cup units 20 during a part of their path of movement so that they will attach themselves to the bottommost sheet in the stack and, upon subsequent downward movement thereof, will withdraw only this sheet from the stack. An idler roller 22 extends slightly above the level of the support tray 6 so that the bottommost sheet normally rests thereon. As the suction cups 20 are lowered, they pull the sheet involved down upon a continuously driven drive roller 24, whereupon pressure rollers 26 rotatably carried on a common shaft 26' supported on crank arms 28—28 are moved upward to press the sheet against the drive roller 24, which then feeds the sheet involved to the conveyor section 3 as suction is removed from the suction cups. As previously explained, the pulling of a semi-rigid cardboard sheet upon the drive roller can cause reaction forces on the sheet which have heretofore caused premature release of the suction cups 20 before the pressure rollers are in position to press the sheet against the drive roller. The sheet then springs back up out of the path of movement of the pressure rollers. The unique cam controlled positioning of the suction cups prevents this premature separation.

The conveyor section 3 is shown as including laterally spaced conveyor belts 27 (FIGS. 1 and 2) extending around drive and driven pulleys 27' and 27". The lateral position of the sheets delivered one at a time from each stack to a particular section of the conveyor belts 27 may be laterally constrained by suitable means (not shown in the drawings) as disclosed in U.S. Pat. No. 4,437,657.

Now that the basic parts of the sheet feeding apparatus have been introduced, the details thereof for the preferred form of the invention illustrated in the drawings will now be described.

Referring now more particularly to FIGS. 1 and 2, the loading section includes a framework upon which the upstanding guide members 14A, 14A', 14A", 14B and 14B' are mounted. This framework includes a pair of upstanding rail support posts 36 extending upwardly from the rear sides of the support tray 6 and a pair of upstanding rail support posts 36' extending upwardly from the front sides of the support tray 6. A horizontal rail 38 extends between posts 36 and 36' on one side of the support tray 6 and a similar rail 38 extends between the posts 36 and 36' on the other side of the support tray 6. Slidably supported along and between the rails 38 is a rear cross rail 39, which has channels on the ends thereof which receive the rails 38, and clamping screws 41 (FIG. 2) which clamp the cross rail 39 in any selected longitudinal position along the associated rails 38. The cross rail 39 carries the rear upstanding guide members 14B and 14B'. Viewed from the conveyor side of the loading station, the upstanding guide member 14B is adapted to receive the rear left corner portion of the stack of sheets involved, and the upstanding guide member 14B' is adapted to receive the rear right corner of the stack of sheets involved. These guide members 14B and 14B' are angle members providing longitudinally extending surfaces like 48' which engage the longitudinal sides of the stack of sheets and transversely extending surfaces like 49' which engage the rear end of the stack of sheets. Each of the upstanding guide members 14B and 14B' has guide and clamping means 40 for securing the associated guide member in any adjusted position on the rail 39. Each guide and clamping means 40 includes a channel bracket **40*b* with a downward opening channel 40*b'* adapted to receive the rail 39 and a clamp screw 40*a* which threads through the bracket to engage the rail 39. The rail 39 is of a sufficient length to accommodate two pairs of the complementary upstanding guide members 14B–14B' if needed so that two laterally spaced stacks of sheets (or envelopes) 16 can be supported on the support tray 6**.

It can be seen that, viewing the loading section from the conveyor side thereof, the left upstanding guide member 14A is adapted to receive the left front corner of the stack of sheets and the right upstanding guide member 14A' is adapted to receive the right front corner of the stack of sheets. Accordingly, these guide members made of angle members have confronting longitudinal surfaces like 50' which engage the longtiduinal sides of the stack of sheets and lateral surfaces like 51' which engage the front ends of a stack of sheets.

The intermediate upstanding guide member 14A" is shown as comprising a vertical strip of metal which provides a surface which engages the front end of the stack of sheets. This upstanding member is not normally needed where relatively narrow sheets of material are to be stacked.

The front upstanding guide members 14A, 14A' and 14A" are mounted for lateral adjustment on a cross rail 44 positioned in confronting relation to the feed opening 19 at the front of the support tray 6. The upstanding guide members 14A, 14A' and 14A" are slidably upported upon rail 44 by guide and clamping means 42 similar to the means 40 and each comprising a channel bracket **42*b* having a downwardly opening channel 42*b'* slidably receiving the cross rail 44, and a clamping screw 42*a* for locking the channel bracket in any desired position along the rail 44**.

Thus, the rear upstanding guide members 14B–14B' are adjustable both laterally and longitudinally of the loading section, the rail 44 carrying the upstanding front guide members 14A, 14A', and 14A" may be (but are not as shown) adjustable longitudinally over a limited distance.

Each of the front upstanding guide members 14A, 14A' and 14A" has a construction best illustrated in FIGS. 3 and 4, wherein is shown the bottom construction of the righthand upstanding member 14A', it being understood that the bottom portion of the other front upstanding guide members 14A and 14A" have the same construction as there shown. Thus, each of these members has a longitudinally adjustable sprirg finger support lip 21 at the bottom thereof which supports the bottom of the front ends of the sheets of ma&.erial involved in a manner to assure that only one sheet at a time is fed from the stack involved by the suction cups 20. Each spring lip 21 extends laterally from a vertical support arm **21*a*. The vertical arm 21*b* is sandwiched between the rear leg 52 of the channel bracket 42*b* and the adjacent wall of the associated upstanding guide member. A locking screw 56 threading into an opening in the bracket leg 52 securely clamps the upper portion of the vertical arm 21*a* in place. The bottom end of the bracket leg 52 has a tapered portion 52*a* which forms a clearance space 53 in which the lower portion of the vertical arm 21*b* may be moved in a longitudinal direction by the adjustment of a screw 58 threading into an opening in the bottom portion of the bracket leg 52. Thus, by rotating the adjusting screw 58, the degree to which the support ledge-forming spring lip 21** projects rearwardly beyond the adjacent wall of the upstanding guide member which engages the front end of the stack of sheets is varied to accommodate sheets of different stiffness and flexibility.

The four suction cup bodies 20 have mounting flanges **20*b*—20*b* (FIG. 12) into which are threaded adjusting screws 67 slidable in slots 68 in the support bar 23 so that each of the suction cup units can be adjusted over a limited horizontal extent to provide the best combination of suction cup positions for a given sheet stacking arrangement. Individual suction tubes 21 extending from the suction cup unit bodies 20*b* may connect to a housing 71' (FIGS. 2 and 14) of a control valve 71 which includes a control knob 73 (FIG. 6) which selectively controls the feeding of suction to all or selected ones or pairs of the suction cup units 20-1, 20-2, 20-3, or 20-4. A suction line 75 extends from the control valve 71** to the inlet side of a suitable pr.mp (not shown). This is a unique means of controlling suction to the suction cups which is the subject of another patent application.

Drive power for the feeding and coveyor sections of the sheet feeding apparatus of the exemplary form of the invention being described is best shown in FIGS. 1, 5 and 6 to which reference is now made. An electric motor 66 drives a speed reducer 67 which imparts continuous rotation to a drive shaft 70 having a sprocket 72 at one end thereof which drives a chain 74 extendirg over another sprocket 74'. A pulley and belt transmission generally indicated by reference numeral 76 continuously operates various drive shafts (some not shown), such as the shaft of the aforementioned conveyor belt pulley 27" which carries a pulley 77 and belt 77' which drives a shaft (not shown) which carries the drive roller 24.

The chain sprocket 74' is secured to the power input shaft 75 of any suitable single cycle operating clutch mechanism 78 (FIG. 5) controlled by a solenoid 79 which preferably receives a pulse from electric eye switches located below apertures 8 (FIG. 1) in a ledge 8" at the front of the conveyor section 3. When a sheet is delivered to the end of the conveyor section 3, it rests against a stop wall 3' adjacent the ledge and reflects light upon the light sensors of the electric eye switches. When a suction cup pick-up device associated with a sheet reclining device like a printer raises the sheet from the conveyor section, the reflected light then operates the switches. This switch operation operates the solenoid 79 to permit the clutch 78 to rotate a cam control shaft 80 one revolution each time the solenoid is momentarily energized as described. (The solenoid 79 may have a spring urged locking pawl, not shown, which is withdrawn from a slot in a drive shaft of the clutch mechanism to permit a 360° rotation when the pawl again enters the slot to stop shaft rotation.) The electric eye switches referred to thus effect automatic internal synchronism of the sheet feeding apparatus independently of the speed of operation of the motor 66. This unique sheet feed synchronizing system just described is the subject of another patent application.

As shown in FIG. 5, the cam control shaft 80 carries at the right hand end thereof as viewed in this figure a cam 81 which controls the up and down movement of the pressure roller-carrying shaft 26', a cam 82 which controls the up and down movement of the suction cup support bar 23, and a suction control cam 81'. To reduce the overall width of the apparatus shown, the shaft 80 has a left hand portion 80' which extends within the clutch input shaft 75 so as to be exposed to the left of a belt pulley carried on the shaft 75. (It is apparent that the shaft 75 of the clutch mechanism 78 could be located totally to the left of the entire cam shaft 80 but this would require widening of the housing 4.)

Cam follower rollers 83—83 carried on pivotably mounted crank members 28—28 ride on the surface of the cams 81—81 to control the up and down movement of the pressure roller shaft 26' in a manner to be described. A follower roller 90*b* carried on a crank member 86 controls the up and down movement of the suction cup support bar 23 in a manner now to be described. A roller 135 rides on the suction control cam 81' to move a vacuum breaklng head 81" (FIG. 14) toward and away from the suction control valve 71.

FIG. 7A shows the position of control cam 82 when the suction cup support bar 23 is in its lowermost position. The suction cup units 20 on the mounting bar 23 are movable between the lowermost position shown in FIG. 7A to an uppermost position shown in FIG. 7B. Secured to the ends of the support bar 23 are end brackets 102—102 best seen in FIGS. 9-12. Each bracket includes a vertical portion 102*a* which terminates in an outwardly extending flange 102*b*. The vertical portion 102*a* of each bracket is pivotally mounted at 101 to a forwardly projecting arm 98*c* of a crank member 98 pivoted on a pivot axis 99.

A spring 105 mounted in an upwardly opening recess in the arm 98*c* applies an upward force against the associated flange 102*b* to urge each bracket 102 in a clockwise direction as viewed in the drawings. A cam follower roller 103 rotatably mounted at the bottom end of each vertical portion 102*a* of each bracket 102 is urged by the associated spring 105 against downwardly facing surface 119' of a stationary cam 119.

The position of the cam follower rollers 103—103 carried by the brackets 102—102 determines the angle of inclination of the suction cup mounting bar 23 and the gripping planes of the flexible suction cups 20*a* of the suction cup units 20. As previously explained, the suction cups 20*a* initially make contact with the bottommost sheet in the stack of sheets involved at positions where their gripping planes are parallel to the sheets. The suction cups are then raised slightly from this position and then pivoted in a counterclockwise direction as viewed in the drawings, to facilitate separation of the bottommost sheet from the sheet above the same. This counterclockwise movement is achieved by the movement of the follower rollers 103 to the right over the outermost portions 119-4 of the cam surfaces 119'.

Each crank member 98 has a central hub 98*a* pivoted on a pivot axis 99. The right crank member 98 has an arm 98*b* pivotally secured to one end of a link 96 at 95'. The other end of the link 96 is pivoted at 95 to a rearwardly extending arm 86*a* of one of the crank members 86 mounted on a shaft 84 for pivoting movement about a pivot axis 88'. Each crank member 86 has an arm 86b urged rearwardly by a coil spring 89 connected between a stationary pin 89' and a pin 89" on the arm 86*b*. The coil spring 89 urges the follower roller 90*b* carried by only the right crank member 98 shown in FIG. 5 against the associated cam 82. The follower roller 90*b* forms part of a follower roller assembly 90. As previously indicated, the cam 82 mounted upon the right end of the shaft 80 makes a single revolution each time the control solenoid 79 receives a single control pulse resulting from the raising of a sheet from the end of the conveyor section 3, and in so doing, causes the crank members 98—98 to rock back and forth once to cause the roller 103 to transverse cam surface portions 119-1, 119-2, 119-3 and 119-4. In so doing, the gripping planes of the suction cups 20*a* vary as shown in FIG. 13.

The follower roller assembly 90 includes a support frame 90*a* upon which the follower roller 90*b* is rotatably mounted. The support frame 90*a* is pivotably mounted about a pivot pin 86*d* projecting from an arm 86*c* of the associated crank member 86. The crank arm 86*c* has an outermost portion 86*c*' through which is threaded an adjusting screw 92. The bottom end of this screw 92 bears against the upper surface 90*a*' of the roller support frame 90*a*. As the screw 92 is rotated in one or the other direction the crank member 86 is pivoted in one direction on the other to vary the spacing between the follower roller assembly 90 and the crank arm 86*c* and the angular position of the crank arm 86 for a given position of the follower roller 90*b* on the cam 82. A lock nut 94 is threaded around the screw 92 to lock the screw in its adjusted position. It can thus be seen that as the screw 92 is adjusted, the peak elevations reached by the crank arm 86c and the crank arms 98c—98c constituting the carrier for the suction cup units are adjusted.

As the cam 82 is rotated in a clockwise direction from the position shown in FIG. 7A where the suction cups 20a are in their lowermost positions, the crank members 98—98 carrying the same are pivoted by the linkage described in a counterclockwise direction to gradually raise the crank member arms 98c—98c to move the follower rollers 103 along the cam surfaces 119'. In FIG. 7A, it is noted that the roller 90b is not touching the cam 82. This is so because the surface of the cam 82 has not yet reached a point where it will engage the roller 90b. The linkage mechanism thereshown need only be operated by the cam 82 over a portion of the rotation of the cam 82 where it is desired to begin raising the suction cups 20 into the various positions described.

FIG. 13 illustrates four different angular positions A, B, C, and D which the gripping planes of the suction cups 20a have as they are progressively lowered (or raised) to the point where they first make parallel contact with the bottommost sheet 16 diagrammatically illustrated. The suction cups are raised a short distance above this position to its peak position A' where they have been pivoted counterclockwise away from the lips 21. As the suction cups are raised, they progressively have the positions D, C, B, A, and A' (before they have gripped and pulled a sheet of material from the bottom of the stack). When the suction cups are lowered from the peak position A', suction cups have the progressive positions A, B, C, and D. In position B, the suctions cups have pulled the front end of the sheet 16 down to where it strikes the upper surface of the drive roller 24. As the suction cups are lowered from this position to position C the sheet 16 will progressively contact additional points on the surface of the drive roller. It is noted that as the sheet is thus progressively wrapped around the upper surface of the drive roller, it extends along progressively varying tangent lines like L1 and L2. One of the aspects of the invention is that in order to prevent premature separation of the suction cups from a rigid sheet of material, the gripping planes of the suction cups should be substantially parallel to the tangent lines like L1 and L2 as illustrated until suction is interrupted at position C. The suction cups are then lowered further to position D.

When the suction cups 20 are in position C where suction is removed, a rigid or semi-rigid sheet will then spring upwardly. If the suction cups had released from a rigid sheet 16 before position C which sometimes occurred in the prior art which did not use the suction cup plane control as described, the rigid sheet would spring upwardly and return to the plane of the bottom of the stack of sheets prior to the time the rising pressure rollers 26 reached a point where the sheet would be caught by the rollers moving upwardly and toward the drive roller 24. However, as shown in FIG. 13 when the suction cups leave contact with the sheet in position C, the pressure rollers 26 are already in a position where the sheet 16 will be caught by the rollers 26 which will thus ultimately press the sheet down upon the feed roller 24 as the pressure rollers assume the position shown in FIG. 7A. In this position, the drive roller 24 effects complete removal of the sheet 16 from the stack of sheets and directs the sheet first upon the downwardly and forwardly inclining directing plate 120 which then directs it upon the inlet end of the conveyor section 3.

Refer now to FIGS. 8A and 8B which show the cam and crank member apparatus involved in the raising and lowering of the pressure rollers 26. As previously explained, the cam shaft 80 carries on the opposite ends thereof cams 81—81, one of which is shown in FIGS. 8A and 8B. (It should thus be understood that the apparatus shown in FIGS. 8A and 8B are duplicated at the opposite end of the shaft 80.) Follower roller 83 is shown engaging the surface of the cam 81. The roller 83 is rotatably mounted upon a roller carrier frame 126 which is pivoted at 130 to one of the arms 28b of crank member 28. The crank member 28 is pivotably mounted on the same shaft 84 which carries the crank members 86—86 which control the up and down movement of the suction cups. The crank arms 28—28 will rotate on the shaft 84 in opposite directions to the direction of rotation of the crank members 86—86. The crank arm 28b has a boss 122 with a threaded bore 122a into which is threaded an adjusting screw 124 which adjusts the o spacing between the crank arm 28b and a shoulder 126' of the roller carrier frame 126. A spring 128 extending between a stationary pin 129 and a pin 129' on the roller carrier frame 126 urges the roller 83 upon the surface of the cam 81. Adjustment of the screw 124 adjusts the angular position of the crank member 28 for a given positon of the roller 83 on the surface of the cam 82.

The crank member 28 has an arm 28a which carries the pressure roller carrying shaft 26'. As the cam 82 is rotated in a clockwise direction from the position shown in FIG. 8A which shows the uppermost position of the pressure roller 26 resting against the drive roller 24, the roller carrying shaft 26' is progressively dropped to the lowermost position shown in FIG. 8B as the suction cups 20a are moved to their uppermost position shown in FIG. 7B.

FIG. 14 illustrates the manner in which the suction of the suction cups is controlled. As previously indicated, any suitable control valve 71' may be utilized from which extends the various tubes 21 which extend to the suction cups. The valve 71' has a bleeding aperture 71a which when open terminates in a suction to the tubes 21. The valve cover 81'' is carried on the end of a handle member 139 which is welded or otherwise secured to a roller-carrying arm 137. Assembly of the roller carrying arm 137 and the angle member 139 are pivoted about a horizontal axis 141. The arm 137 carries a cam follower roller 139 which rides on the surface of the cam 81'. If the cam rotates, the force of the cam surface on the roller 135 will cause the arm 137 and the angle member 139 to pivot about the pivot axis 141 to raise and lower the valve cover 81'' to open and close the vent apertures 71. The vent cover 81'' will cover the vent opening 71a as the suction cups are moved into position where they first engage the bottom sheet of the stack of sheets as the suction cups are lowered to the position C shown in FIG. 13. Thereafter the vent opening 71a is opened as the vent cover 81'' is moved away from the front aperture 71a. It is thus apparent that the present invention provide a unique and advantageous manner for controlling both the back elevation of the suction cups and the gripping planes thereof to provide for a most reliable removal of sheets of all degrees of flexibility from a stack of sheets.

It is intended that broad claims not specifying details of a particular embodiment disclosed herein as the best mode contemplated for carrying out the invention should not be limited to such details. Further, while specific claimed details of the invention generally constitute important specific aspects of the invention, in appropriate instances even the specific claims involved should be construed in light of the doctrine of equivalents.

I claim:

1. In feeding apparatus including a horizontal support for a stack of sheets; stacking means for retaining on said horizontal support a vertical stack of sheet material, said horizontal support terminating short of the front end of the stack to provide a feed opening exposing the front end portion of the bottom sheet in the stack; support ledge-forming means confronting said feed opening for supporting the weight of the front end of the stack of sheets; and means for withdrawing the front end portion of the bottommost sheet from the bottom of the stack through said feed opening and including suction cup means having a gripping plane for engaging the bottom surface of the exposed front end portion of the bottommost sheet in the stack and by force of suction pulling the same downwardly from the stack through the feed opening, a movable support structure for said suction cup means and including carrier means bodily movable between an initial lowered position to a raised position where the suction cup means carried thereby initially contact and then push upwardly against the exposed end portion of the bottommost sheet in the stack and suction cup mounting means upon which said suction cup means are directly supported, said mounting means being mounted for pivotal movement upon said carrier means so that the suction plane of the mouths of said suction cup means can be adjusted to different angles of inclination relative to said carrier means, and position control means for controlling the position and inclination of said mounting means on said carrier means by raising said carrier means to a position where the suction cup means on said mounting means initially engages the bottom surface of the bottommost sheet of the stack, with the suction plane thereof parallel to the sheet, then raising the same a small distance further while tilting said mounting means on said carrier means in a direction away from the said support ledge-forming means and without any substantial horizontal movement thereof away from said support ledge-forming means, and following which said carrier means is lowered to pull the front end of the bottommost sheet past said support ledge-forming means with a wiping contact thereof to withdraw only the bottommost sheet from the stack; the improvement wherein said position control means includes elevation adjusting means for manually progressively adjusting the peak elevation reached by said carrier means and the suction cup means carried thereby, and said position control means including stationary cam means against which a follower portion of said suction cup mounting means rides to vary the inclination of said mounting means relative to said carrier means, said follower portion engaging a different portion of said cam means as the elevation of said carrier means is varied.

2. In feeding apparatus including: a horizontal support for a stack of sheets; stacking means for retaining on said horizontal support a vertical stack of sheet material, said horizontal support terminating short of the front end of the stack to provide a feed opening exposing the front end portion of the bottom sheet in the stack; support ledge-forming means confronting said feed opending for supporting the weight of the front end of the stack of sheets; means for withdrawing the front end portion of the bottommost sheet from the bottom of the stack through said feed opening and including suction cup means having a gripping plane for engaging the bottom surface of the exposed front end portion of the bottommost sheet in the stack and by force of suction pulling the same downwardly from the stack through the feed opening; a movable support structure for said suction cup means and including carrier means bodily movable between an initial lowered position to a raised position where the suction cup means carried thereby initially contact and then push upwardly against the exposed end portion of the bottommost sheet in the stack, and suction cup mounting means upon which said suction cup means are directly supported, said mounting means being mounted for pivotal movement upon said carrier means so that the suction plane of the mouths of said suction cup means can be adjusted to different angles of inclination relative to said carrier means, and position control means for controlling the position and inclination of said mounting means on said carrier means by raising said carrier means to a position where the suction cup means on said mounting means initially engages the bottom surface of the bottommost sheet of the stack, with the suction plane thereof parallel to the sheet, then raising the same a small distance further while tilting said mounting means on said carrier means in a direction away from the said support ledge-forming means and without any substantial horizontal movement thereof away from said support ledge-forming means, and following which said carrier means is lowered to pull the front end of the bottommost sheet past said support ledge-forming means with a wiping contact thereof to withdraw only the bottommost sheet from the stack; the improvement wherein said position control means includes stationary cam means against which a follower portion of said suction cup mounting means rides to vary the inclination of said mounting means relative to said carrier means, said follower portion engaging a different portion of said cam means as the elevation of said carrier means is varied.

3. The feeding apparatus of claim 2 wherein said position control means includes a rotatable cam means mounted for rotation on a first shaft and having a peripheral cam surface which varies in position relative to the axis of rotation of cam means; a pivotally mounted crank member, a pivotally mounted first follower member which has a portion thereof engaging said cam surface to be variably pivoted thereby as said rotatable cam means is rotated, said crank member having a spring-urged arm which urges the follower portion of said first follower member against said cam surface; and peak elevation adjusting means for progressively varying the spacing between said arm and follower member progressively to vary the angular position of said crank arm for a given position of said follower portion of said follower with respect to a point on the surface of said rotatable cam means, and means for coupling the movement of said crank member to said carrier means to vary the elevation of said carrier means in accordance with the position of said crank member.

4. In feeding apparatus including a horizontal support for a stack of sheets; stacking means for retaining on said horizontal support a vertical stack of sheet material, said horizontal support terminating short of the front end of the stack to provide a feed opening exposing the front end portion of the bottom sheet in the stack; and means for withdrawing the front end portion of the bottommost sheet from the bottom of the stack through said feed opening and including suction cup means having a gripping plane for engaging the bottom surface of the exposed front end portion of the bottommost sheet in the stack and by force of suction therefrom pulling the same downwardly from the stack through the feed opening, a movable support structure for said suction cup means and including carrier means bodily movable between an initial lowered position to a raised position where the suction cup means carried thereby initially contacts the exposed end portion of the bottommost sheet in the stack, and suction cup mounting means upon which said suction cup means are directly supported, said mounting means being mounted for pivotal movement upon said carrier means so that the suction plane of the mouths of said suction cup means can be adjusted to different angles of inclination relative to said carrier means; a horizontal cylindrical drive roller upon the upper portion of which the bottom surface of the front end portion of the sheet is pulled down and around the front thereof by the suction cup means, and pressure roller means which are moved into superimposed relation with the sheet to press the sheet against the drive roller and effect complete feeding of the sheet from the stack; suction cup position control means for raising and lowering said carrier means and the suction cup mounting means carried thereby where the suction cup means on said mounting means initially engages the bottom surface of the bottommost sheet of the stack, and following which said carrier means is lowered to pull the front end of the bottommost sheet to withdraw only the bottommost sheet from the stack, pressure roller position control means for lowering and raising said pressure roller means, and means for terminating suction to said suction cup means when lowered to a given position; the improvement wherein said suction cup position control means includes means for controlling the angle of said suction cup to cause the gripping plane of said suction cup means to be maintained parallel to a tangent line of the charging last point of contact of the front end portion of the sheet as it is pulled down upon and around the front portion of said cylindrical drive roller until separation of the suction cup means therefrom is desired, and said pressure roller position control means raising the pressure roller means to a position where, upon release of suction from said suction cup means, said pressure roller means is in position to catch a rigid sheet as it springs back to a raised position.

5. The feeding apparatus of claim 4 wherein said suction cup position control means is stationary cam means against which a follower portion of said suction cup mounting means rides to vary the inclination of said mounting means relative to said carrier means, said follower portion engaging a different portion of said cam means as the elevation of said carrier means is varied.

6. The feeding apparatus of claim 4 wherein said suction cup position control means includes a rotatable cam means mounted for rotation on a first shaft and having a peripheral cam surface which varies in position relative to the axis of rotation of the cam means; a pivotally mounted crank member; a pivotally mounted first follower member which has a portion thereof engaging said cam surface to be variably pivoted thereby as said rotatable cam means is rotated, said crank member having a spring-urged arm which urges the follower portion of said first follower member against said cam surface; and peak elevation adjusting means for progressively varying the spacing between said arm and follower member to vary the angular position of said crank arm for a given position of said follower portion of said follower with respect to a point on the surface of said rotatable cam means.

* * * * *